US005242510A

United States Patent [19]

Begin

[11] Patent Number: 5,242,510

[45] Date of Patent: Sep. 7, 1993

[54] ALLOYED GREY IRON HAVING HIGH THERMAL FATIGUE RESISTANCE AND GOOD MACHINABILITY

[75] Inventor: Roger E. Begin, Dearborn, Mich.

[73] Assignee: Detroit Diesel Corporation, Detroit, Mich.

[21] Appl. No.: 951,096

[22] Filed: Sep. 25, 1992

[51] Int. Cl.[5] ..... C22C 37/10

[52] U.S. Cl. ..... 148/321; 420/26

[58] Field of Search ..... 148/321; 420/26

[56] References Cited

U.S. PATENT DOCUMENTS

| | | | |
|---|---|---|---|
| 1,707,753 | 4/1929 | Boegehold | 420/9 |
| 2,485,761 | 10/1945 | Millis | 420/13 |
| 2,809,888 | 10/1957 | Schelleng | 420/26 |
| 3,623,922 | 11/1971 | Williams et al. | 148/321 |
| 4,166,756 | 9/1979 | Geyer et al. | 148/321 |
| 4,194,906 | 3/1980 | Krantz et al. | 420/9 |
| 4,419,801 | 12/1983 | Yamashita et al. | 29/156.4 |
| 5,028,281 | 7/1991 | Hayes et al. | 148/321 |

FOREIGN PATENT DOCUMENTS

| | | | |
|---|---|---|---|
| 61-110746 | 5/1986 | Japan | 420/26 |

OTHER PUBLICATIONS

The Effects of Alloying Elements on the Elevated Temperature Properties of Gray Irons by R. B. Gundlach, Reprinted from 1983 AFS Transactions.

A Modern Approach to Allowing Gray Iron, by J. F. Janowak and R. B. Gundlach, Apr. 1982, AFS Transactions.

Thermal Fatigue Resistance of Alloyed Gray Irons for Diesel Engine Components, R. B. Grundlach, AFS Transactions.

GM Specification GM 4249P.

GM Engineering Standards, Material Processes, Jan. 1986, pp. D-21.102-21.105.

*Primary Examiner*—Deborah Yee

*Attorney, Agent, or Firm*—Brooks & Kushman

[57] ABSTRACT

A moderately high carbon alloy grey iron having a carbon content ranging from 3.4% to 3.6% by weight and a primary alloying addition of the combination of molybdenum and copper in amounts by weight ranging from 0.25% to 0.40% and from about 0.30% to 0.60%, respectively for achieving thermal fatigue resistance and good machinability without adversely affecting chill depth, and with a relatively low silicon content of about 1.80% to 2.10%. The alloyed grey iron having the characteristics of:

(i) a microstructure of a fully pearlitic matrix having a refined eutectic cell size, and graphite present in substantially uniform distribution and random orientation, the graphite having a flake size of predominantly 5-7 ASTM;

(ii) a tensile strength of at least 40,000 psi in the desired section size;

(iii) a hardness of about 179 to about 229 Brinell.

6 Claims, 1 Drawing Sheet

ALLOYED GREY IRON HAVING HIGH THERMAL FATIGUE RESISTANCE AND GOOD MACHINABILITY

TECHNICAL FIELD

The invention relates to alloyed grey iron castings wherein the principal alloy constituent in addition to carbon and silicon is molybdenum and copper, and is particularly related to such castings for use as diesel engine cylinder heads and exhaust manifolds.

BACKGROUND OF THE INVENTION

Grey iron castings have been in use for internal combustion engine components, notably engine blocks, cylinder heads and exhaust manifolds for many years. Their low cost, excellent castability and good machinability make them ideal for such applications. Where special requirements exist in mechanical properties, these criteria have been met through alloying. Most recently, there has been a great demand for alloyed grey iron having significantly enhanced thermal fatigue resistance while maintaining good machinability.

This interest in thermal fatigue resistance has come about because of engines running hotter to improve performance and to meet the more stringent vehicle exhaust standards. This is true of diesel engines, particularly cylinder heads. With the cylinder head, the most severe thermal fatigue condition occurs in the fire deck during engine heating and cooling. The flame face i.e. the internal surface of the cylinder head which defines a portion of the combustion chamber, is heated by the combustion gases to peak temperatures exceeding 900° F. and sometimes approaching 1300° F. Heat is then conducted to the opposite side of the fire deck nearest the engine coolant. This produces a steep thermal gradient in the fire deck which is sustained throughout engine operation. Once the engine is shut down, the flame face cools and the thermal gradient disappears. The thermal stress produced at the flame face on heating is a compression stress of high magnitude and during prolonged engine operation at high temperatures resulting in creep and stress relaxation. As a result, when the engine is shut down and the thermal gradient disappears, a tensile stress develops at the flame face. Repetition of this thermal stress cycle ultimately produces cracking.

Studies have shown that thermal fatigue resistance, and thus creep, is dependent upon a number of factors, including carbon equivalent, tensile strength, microstructure and the influence of alloying. As regards the addition of alloys, the addition of molybdenum (Mo) is known to be the most effective contributor to enhancing thermal fatigue resistance. The same is true of vanadium (V). These two elements are further unique in that among traditional alloy elements, these alone produce a refinement in eutectic cell size when added to grey iron, and this is known to further enhance thermal fatigue resistance.

On the other hand, chrome, nickel and copper are known to have a very small multiplying factor on thermal fatigue resistance over and above their effect on tensile strength. However, a combination of molybdenum and chromium in an alloy has been found to be particularly beneficial because of the ability of chromium to resist the breakdown of cementite in a fully pearlitic matrix, thereby enhancing structural stability and preventing deterioration over long periods of operation and use. Chromium and vanadium are expensive, however, and can have an adverse effect on good machinability. Thus, there are many trade-offs in cost and in material characteristics in determining the most effective alloying additions to grey iron for a casting meeting the requirements for diesel engine cylinder head applications.

A further factor in producing the most effective and inexpensive alloyed grey iron casting for these applications is the methodology of foundry practices as it relates to critical alloying elements. In other words, production of these castings as a commercial practicality is based upon the extensive use of existing charge and return materials as well as alloying additions that typically result in alloy content (i.e. Ni, Si, Cr and possibly even carbon) unacceptable or unnecessary to this invention. This scrap iron includes all manner of alloying additions, including high nickel, chromium, silicon, (others) which may make unacceptable the use of such scrap for these particular purposes.

SUMMARY OF THE INVENTION

The invention therefore contemplates an alloyed grey iron having the usual characteristics expected of grey iron castings for application as engine blocks, cylinder heads and exhaust manifolds, in addition to excellent thermal fatigue resistance to thereby maintain at an acceptable minimum the build up of thermal stresses over long periods of operation and many thermal cycles.

The invention further contemplates an alloy grey iron of the type described above, having good machinability and low cost additions of alloying elements.

The invention further contemplates a moderately high carbon alloy grey iron having a carbon content ranging from 3.4% to 3.6% by weight and a primary alloying addition of the combination of molybdenum and copper for achieving thermal fatigue resistance and good machinability, without adversely affecting chill depth.

The invention further contemplates an alloyed grey iron of the type described above, which maintains a chill depth at a minimum by careful selection of alloying elements to the exclusion of vanadium, chromium and titanium and nickel.

The invention also contemplates an alloyed grey iron which is not dependent on nickel as an alloying element.

The invention further contemplates an alloyed grey iron having the following characteristics:

(a) a microstructure of a fully pearlitic matrix having a refined eutectic cell size, and graphite being present in substantially uniform distribution and random orientation, the graphite having a flake size of predominantly 5-7 ASTM;

(b) a tensile strength of at least 40,000 psi in the desired section size;

(c) a hardness of about 179 to about 229 Brinell; and (d) a composition comprising as a percentage of weight:

about 3.40 to 3.60% carbon
about 0.25 to 0.40% molybdenum
about 0.30 to 0.60% copper
about 0.50 to 0.90% manganese
about 1.80 to 2.10% silicon; and
no more than about 0.21% chromium, 0.05% phosphorus, and 0.15% sulphur with the balance being iron and incidental elements.

BEST MODE FOR CARRYING OUT THE INVENTION

Figure 1:
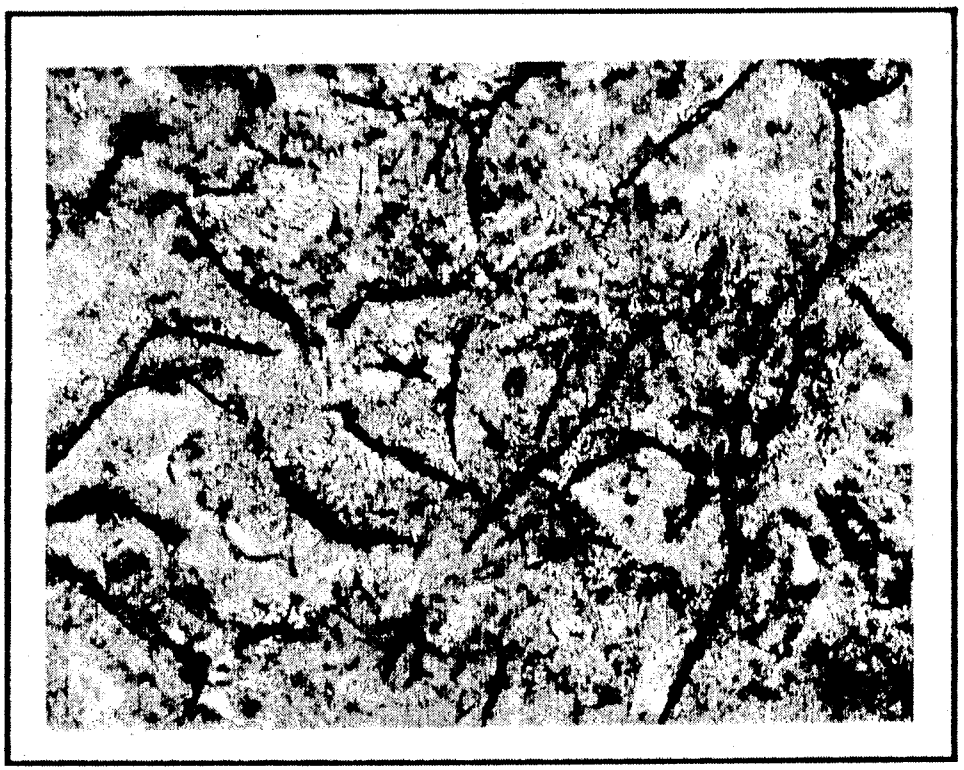
FIG. 1, the sole FIGURE in the drawings, is a photomicrograph of a preferred alloy taken at a magnification of 400× and having a 3% Nital etch.

The preferred chemistry for the alloyed grey iron in accordance with the present invention is set forth in Table I below:

TABLE I

| REFERENCE LIMITS (Percent by Weight) | Preferred (Percent By Weight) |
|---|---|
| Total Carbon 3.40–3.60 | 3.50 |
| Silicon 1.80–2.10 | 1.95 |
| Molybdenum 0.25–0.40 | 0.32 |
| Copper 0.03–0.60 | 0.40 |
| Sulfur 0.15 Max | 0.15 Max |
| Phos 0.05 Max | 0.05 Max |
| Nickel 0.05–0.10 | 0.07 |
| Chrominum 0.25 Max | 0.21 Max |
| Manganese 0.50–0.90 | 0.70 |

Preferably, the copper content will be maintained relative to the molybdenum content at a ratio ranging from about 1:1 to about 2:1. The preferred microstructure is one having a fully pearlitic matrix with a refined eutectic cell size. Graphite in the matrix should be predominantly Type A, preferably a minimum of 90% Type A, and having a flake size of 5–7, per ASTM definition. Type A is defined by the American Society for Testing Materials ("ASTM") as uniform distribution and random orientation. Brinell hardness number will range from 179–229.

Nickel need not be present. Its presence simply adds cost. It is not a necessary alloying element but will usually be present as a residual alloying element, i.e. in amounts of about 0.02 to 0.07%. Greater residual amounts up to about 2.0% are also acceptable and perceived as beneficial.

The presence of phosphorous in amounts up to about 0.05% is desirable as it promotes fluidity of the molten metal. Beyond about that amount, one risks the formation of iron phosphides which can be detrimental to the casting properties.

Sulphur may be present in amounts not exceeding 0.15%. Likewise, it is desirable that manganese be present in an amount equalling 1.7 times the sulphur content plus 0.3% manganese to assure minimizing the chill depth and eutectic cell size.

The castings should be free of detrimental shrinkage and porosity, and stress relieved at 1150°–1160° F. per the publicly known specification GM 4249P. A specification published by General Motors Corporation, the details of which are incorporated herein by reference. Following stress relief the castings should be subjected to standard shakeout procedures.

The tensile strength should be at least about 40,000 psi in the desired section size. For example, in cylinder heads, one should have 40,000 psi tensile strength in the section of the casting constituting the flame deck or face. This would equate to a tensile strength of the same magnitude for a cast test bar meeting ASTM specifications for a 1.2 inch diameter type B tension bar.

The following are specific examples of alloyed grey iron castings for diesel engine cylinder heads in accordance with the invention:

EXAMPLE I

| C | Si | S | P | Cu | Cr | Ni | Mo | Sn | V |
|---|---|---|---|---|---|---|---|---|---|
| 3.46 | 2.06 | 0.09 | 0.02 | 0.22 | 0.25 | 0.091 | 0.280 | 0.021 | 0.001 |

The casting was poured at 2704° F. and stress relieved per GM 4249P specifications. Tensile strength varied from 38,986 psi to 40,053 psi (two samples) using 1.2 diameter test diameter test bar. The Brinell hardness number was 217, and chill depth measured at 10.5 (32's of an inch).

EXAMPLE II

| C | Si | S | P | Cu | Cr | Ni | Mo | Sn | V |
|---|---|---|---|---|---|---|---|---|---|
| 3.40 | 2.03 | 0.08 | 0.02 | 0.44 | 0.24 | 0.088 | 0.280 | 0.021 | 0.000 |

The casting was poured at 2634° F. and stress relieved per GM 42490 specifications. Tensile strength varied from 42,530 psi to 42,045 psi (two samples) using a 0.75 inch diameter test bar. The Brinell hardness number was 229, and chill depth measured at 11.0 (32's of an inch). The microstructure is shown in FIG. 1.

In addition, the following are specific examples of alloyed grey iron castings for diesel engine exhaust manifolds in accordance with the present invention.

| Sample No. | C | Si | S | P | Cu | Cr | Ni | Mo | Mn |
|---|---|---|---|---|---|---|---|---|---|
| 1 | 3.60 | 2.17 | 0.97 | 0.50 | .560 | .225 | .064 | .357 | .620 |
| 2 | 3.52 | 2.05 | .106 | .059 | .542 | .250 | .079 | .384 | .612 |

Casting and subsequent heat treat was generally the same as with the aforementioned cylinder head, Examples I and II.

Tensile Strength:

Sample No. 1—43,500 psi

Sample No. 2—43,600 psi

Brinell Hardness Number:

Sample No. 1—229

Sample No. 2—229

As a point of comparison, the following alloyed grey iron castings shown in Table II are in current, widely accepted use for vehicle cylinder heads and engine blocks.

ALLOYED GRAY IRON CASTINGS
Mechanical and Physical Properties

| GM Number | GM13M | GM6213M | EMS-2 |
|---|---|---|---|
| Hardness HB | 179–229 | 179–255 | 207–262[a] |
| d, mm | 4.5–4.0 | 4.5–3.8 | — |
| Transverse Strength, N | 9 800 min | — | — |
| Transverse Deflection, mm | 5.0 min | — | — |
| Tensile Strength | 205 MPa min | 240 MPa min | 42,000 psi[b] |
| Total Carbon | 3.10–3.40 | 3.10–3.40 | 3.10–3.50 |
| Combined Carbon | — | — | — |
| Manganese | 0.55–0.75 | 0.50–0.70 | 0.50–0.90 |
| Phosphorus | 0.20 Max | 0.15 Max | 0.15 Max |
| Sulfur | 0.20 Max | 0.15 Max | 0.15 Max |
| Silicon | 2.15–2.35 | 2.10–2.40 | 1.80–2.40 |
| Nickel | — | — | 0.60–1.20 |

-continued

ALLOYED GRAY IRON CASTINGS
Mechanical and Physical Properties

| GM Number | GM13M | GM6213M | EMS-2 |
|---|---|---|---|
| Chromium | 0.20–0.40 | 0.20–0.40 | 0.30–0.50 |
| Molybdenum | — | — | 0.05–0.70 |
| Copper | — | — | 0.20–0.60 |
| Micro-structure | — | Pearlitic | Pearlitic[c,d] |

[a]Hardness, Brinell (HB 3000), on fire deck adjacent to valve seats - 207-262.
[b]Tensile Strength, psi minimum - 42,000 (Test specimen taken from the fire deck of the head.)
[c]Chill: No chill resulting from core wash, mold wash and/or metallic chills in lower jacket around injector well or on any machined surface (interior or exterior).
[d]Microstructure: Matrix to be 90% (minimum) pearlite, graphite 90% (minimum) ASTM Type A flakes; all graphite types sizes 4 to 5. Only scattered carbides permitted; no massive carbides allowed. (Metallographic specimen taken from the fire deck, neglect skin effects when analyzing matrix.)

Comparing the grey iron chemistry of Tables I and II, it will be noted that those in common use as cylinder heads and engine blocks generally, i.e. GM 13M and 6213M, are basically low carbon alloys having no molybdenum and consequently possessing insufficient thermal fatigue resistance (thermal life) properties and higher thermal creep properties. On the other hand, alloyed grey iron EMS-2 is specifically designed for use in diesel engine cylinder heads where thermal fatigue resistance is important, as is machinability. Thus molybdenum is present in what, in accordance with the present invention, is recognized as being an over-abundance to that required for excellent thermal fatigue resistance. Copper is also present, for microstructural stability of the pearlite. The silicon content is excessively high for purposes of the present invention, and chromium, nickel and vanadium—all expensive alloy additives—are present. Further, the chromium content range i.e. 0.20–0.40, is so wide and indicated acceptable percentage amounts so high that machinability can be adversely affected.

Likewise, there is no apparent correlation between molybdenum and copper content.

The preferred composition of the grey iron alloy, as shown in Table I, has for one primary focus the maximum control of chromium, nickel, vanadium and other similar and expensive alloy constituents. A variable nickel content is allowable and can be minimized without any significant adverse effect. The strong influence of molybdenum on thermal fatigue resistance is well known, but what is a particularly surprising result of the subject invention is the apparent influence of copper as a multiplying factor on thermal fatigue resistance. It is a further surprising result to note that even without the addition of vanadium, and at the lower molybdenum content, the eutectic cell size refinement can be maintained.

While the best mode for carrying out the invention has been described in detail, those familiar with the art to which this invention relates will recognize various alternative designs and embodiments for practicing the invention as defined by the following claims.

What is claimed is:

1. An alloyed grey iron comprising:

(a) a microstructure of a fully pearlitic matrix having a refined eutectic cell size, and graphite being present in substantially uniform distribution and random orientation, the graphite having a flake size of predominantly 5–7 ASTM;

(b) a composition comprising as a percentage by weight:

about 3.40 to 3.60% carbon
about 0.25 to 0.40% molybdenum
about 0.30 to 0.60% copper
about 0.50 to 0.90% manganese
about 1.80 to 2.10% silicon; and no more than about 0.25% chromium and 0.15% sulphur with the balance being iron and incidental elements commonly found in cast iron.

2. An alloyed grey iron comprising:

(a) a microstructure of a fully pearlitic matrix having a refined eutectic cell size, and graphite being present in substantially uniform distribution and random orientation, the graphite having a flake size of predominantly 5–7 ASTM;

(b) a tensile strength of at least 40,000 psi;

(c) a hardness of about 179 to about 229 Brinell; and (d) a composition comprising as a percentage by weight:

about 3.40 to 3.60% carbon
about 0.25 to 0.40% molybdenum
about 0.30 to 0.60% copper
about 0.50 to 0.90% manganese
about 1.80 to 2.10% silicon; and no more than 0.21% chromium, 0.05% phosphorus 2.0% nickel and 0.15% sulphur with the balance being iron and incidental elements consisting of residual alloying elements and impurities commonly found in cast iron.

3. An alloyed grey iron for use as an internal combustion engine component such as a cylinder head, engine block, exhaust manifold, or other similar component or application where the properties of good machinability and resistance to thermal fatigue are desired comprising:

(a) an as-cast microstructure of a fully pearlitic matrix having a refined eutectic cell size, and graphite being present in substantially uniform distribution and random orientation, the graphite having a flake size of predominantly 5–7 ASTM;

(b) a tensile strength of at least 40,000 psi in an ASTM specified 1.2 inch diameter Type B tension bar specimen;

(c) a hardness of about 179 to about 229 Brinell; and (d) a composition comprising as a percentage by weight:

about 3.40 to 3.60% carbon
about 0.25 to 0.40% molybdenum
about 0.30 to 0.60% copper
about 0.50 to 0.90% manganese
about 1.80 to 2.10% silicon; and no more than 0.21% chromium, 0.05% phosphorus, 0.10% nickel and 0.15% sulphur with the balance being iron and incidental residual alloying elements and impurities commonly found in cast iron.

4. An alloyed grey iron as defined in claim 3 wherein said composition comprises:

about 3.50% carbon
about 0.70% manganese
about 1.95% silicon
about 0.40% copper and
about 0.32% molybdenum.

5. The alloyed grey iron of claim 3 wherein the copper content relative to the molybdenum content range from about 1:1 to about 2:1.

6. The alloyed grey iron of claim 3 wherein manganese is present in an amount at least equalling 1.7 times the sulphur content plus 0.3 percent manganese whereby the chill depth and eutectic cell size of the microstructure will be enhanced.

* * * * *